US009288847B2

(12) United States Patent
Kim et al.

(10) Patent No.: US 9,288,847 B2
(45) Date of Patent: Mar. 15, 2016

(54) COLD CRUCIBLE INDUCTION MELTER INTEGRATING INDUCTION COIL AND MELTING FURNACE

(75) Inventors: Cheon-Woo Kim, Yuseong-gu Daejeon (KR); Seok-Mo Choi, Yuseong-gu Daejeon (KR); Hyun-Jun Jo, Yuseong-gu Daejeon (KR); Jong-Kil Park, Gyeonggi-do (KR); Young-Bu Choi, Yuseong-gu Daejeon (KR)

(73) Assignee: KOREA HYDRO & NUCLEAR POWER CO., LTD, Gyeongsangbuk-Do (KR)

( * ) Notice: Subject to any disclaimer, the term of this patent is extended or adjusted under 35 U.S.C. 154(b) by 144 days.

(21) Appl. No.: 13/823,141

(22) PCT Filed: Sep. 27, 2010

(86) PCT No.: PCT/KR2010/006552

§ 371 (c)(1),
(2), (4) Date: Mar. 14, 2013

(87) PCT Pub. No.: WO2012/036334

PCT Pub. Date: Mar. 22, 2012

(65) Prior Publication Data

US 2013/0182740 A1 Jul. 18, 2013

(30) Foreign Application Priority Data

Sep. 15, 2010 (KR) ..... 10-2010-0090786

(51) Int. Cl.
*F27D 3/00* (2006.01)
*H05B 6/22* (2006.01)
(Continued)

(52) U.S. Cl.
CPC .. *H05B 6/36* (2013.01); *F23G 5/10* (2013.01); *F27B 14/063* (2013.01); *F27B 14/14* (2013.01); *H05B 6/24* (2013.01); *F23G 2204/204* (2013.01)

(58) Field of Classification Search
CPC ..... H05B 6/24; H05B 6/36; H05B 6/367; F27B 14/063; F27B 14/00; F27B 14/06; F27B 14/061; F27B 14/065; F27B 14/08; F27B 14/0806; F27B 2014/002; F27B 2014/008; F27B 2014/0837
USPC ..... 373/142, 156, 158, 138, 139, 144, 146, 373/163
See application file for complete search history.

(56) References Cited

U.S. PATENT DOCUMENTS 3,223,519 A 12/1965 Schippereit
3,461,215 A 8/1969 Reboux
(Continued)

FOREIGN PATENT DOCUMENTS

DE 518499 2/1931
JP 8-166189 A 6/1996
(Continued)

OTHER PUBLICATIONS

Korean Intellectual Property Office Search Report in International Patent Application No. PCT/KR2010/006552 (Sep. 27, 2011).

*Primary Examiner* — Tu B Hoang
*Assistant Examiner* — Alba Rosario-Aponte
(74) *Attorney, Agent, or Firm* — Leydig, Voit & Mayer, Ltd.

(57) ABSTRACT

A cold crucible induction melter includes an induction coil and a melting furnace. The induction coil serves as a water cooled segment to directly transmit an induced current to a molten material in the cold crucible induction melter (CCIM), improving energy efficiency. Simultaneously, the structure of the CCIM is simplified and enables a smooth discharge even when the molten material consists of a ceramic or a metal material with a high melting point. The cold crucible induction melter heats and melts waste using an induced current which is generated in a water cooled segment by a high frequency current that is applied to the induction coil. The water cooled segment and the induction coil are disposed in a vertical direction so that the induced current that is generated by the induction coil is directly transmitted to the molten material.

10 Claims, 3 Drawing Sheets

(51) Int. Cl.

| | |
|---|---|
| ***H05B 6/36*** | (2006.01) |
| ***F27B 14/06*** | (2006.01) |
| ***H05B 6/24*** | (2006.01) |
| ***F23G 5/10*** | (2006.01) |
| ***F27B 14/14*** | (2006.01) |

(56) References Cited

U.S. PATENT DOCUMENTS 3,709,678 A * 1/1973 Helary et al. ..... 75/10.14
4,058,668 A 11/1977 Clites
4,633,481 A 12/1986 Schwenninger
4,761,528 A * 8/1988 Caillaut et al. ..... 219/628
5,280,496 A * 1/1994 Schlecht et al. ..... 373/158
5,479,438 A * 12/1995 Blum ..... B22D 41/14 373/139
5,563,904 A * 10/1996 Colpo ..... B22D 11/115 222/594
5,889,813 A * 3/1999 Fujita et al. ..... 373/156
5,901,169 A * 5/1999 Kobayashi ..... 373/142
6,097,750 A * 8/2000 Knudsen ..... F27B 14/063 373/142
6,144,690 A * 11/2000 Kusamichi et al. ..... 373/147
6,219,372 B1 * 4/2001 Zabala ..... F27B 14/063 266/201
6,393,044 B1 * 5/2002 Fishman et al. ..... 373/138
6,613,291 B1 9/2003 Sobolev et al.
6,695,035 B2 * 2/2004 Kimura ..... B22D 11/115 164/338.1
8,320,427 B2 * 11/2012 Carter et al. ..... 373/142
2002/0080847 A1 * 6/2002 Tsuda et al. ..... 373/156
2011/0243180 A1 * 10/2011 Kolberg ..... C03B 5/021 373/142

FOREIGN PATENT DOCUMENTS

JP 2006-153408 A 6/2006
JP 2009-222364 A 10/2009
KR 10-2004-0018856 A 3/2004

* cited by examiner

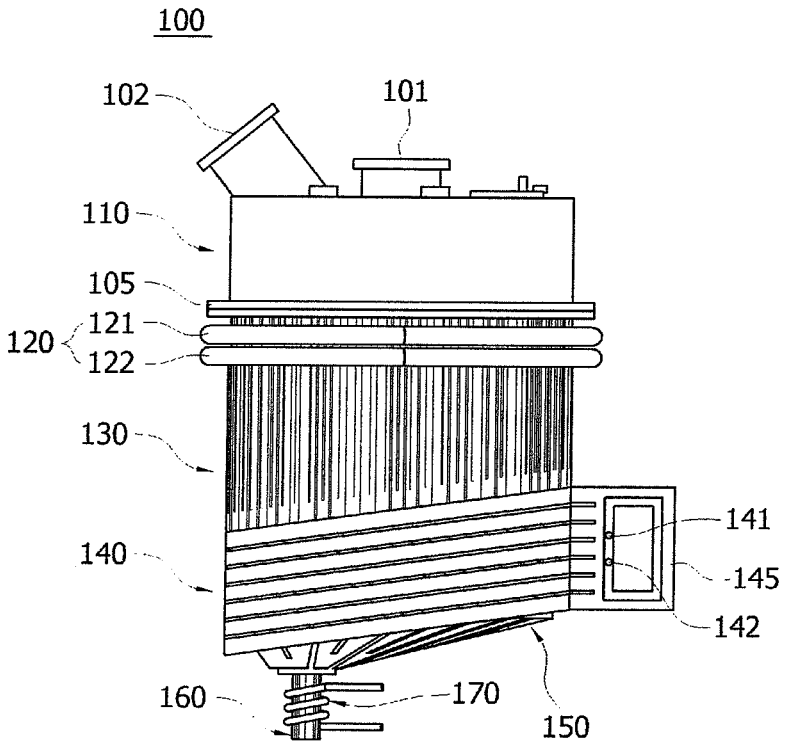
Fig. 1
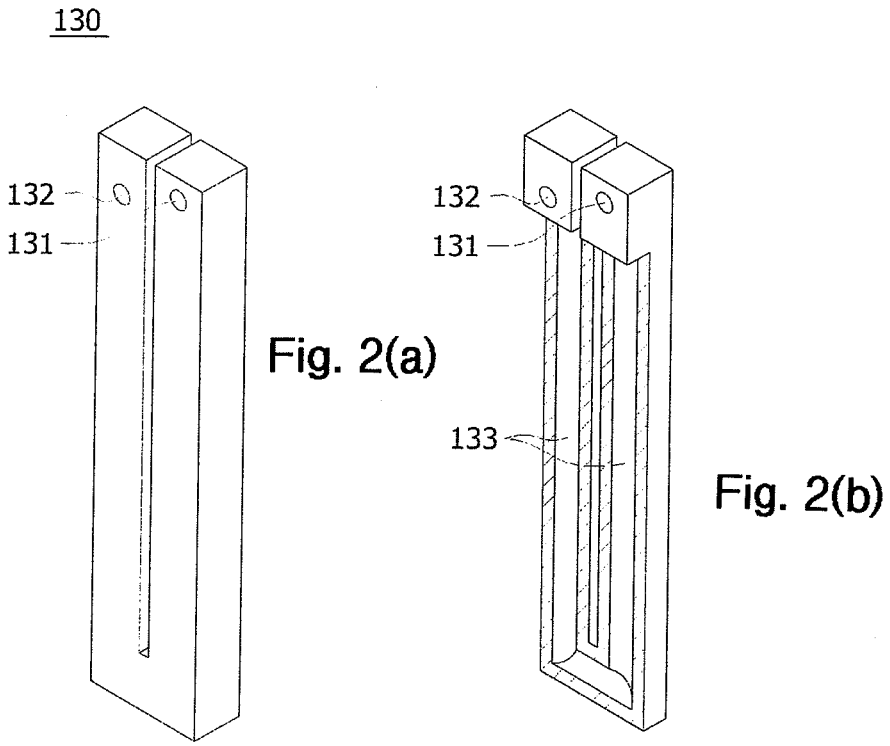
Fig. 2(a)
Fig. 2(b)

COLD CRUCIBLE INDUCTION MELTER INTEGRATING INDUCTION COIL AND MELTING FURNACE

TECHNICAL FIELD

The present invention relates to a cold crucible induction melter integrating an induction coil and a melting furnace, and more particularly, to a cold crucible induction melter (CCIM) which is used for heating and melting materials such as radioactive waste, general industrial waste, ceramic materials, metal materials, or the like by an induction heating method.

BACKGROUND ART

An existing cold crucible induction melter which uses an induction heating method so as to heat and melt radioactive waste, general industrial waste, ceramic materials, metal materials, or the like employs a water cooled pipe or a water cooled segment inside an induction coil.

The existing cold crucible induction melter is configured such that an induced current is generated in water cooled segments due to a high frequency current applied to an induction coil and an induced current is generated in a molten material in the CCIM due to an electromagnetic field formed between the water cooled segments to heat the molten material due to Joule's effect. In this case, the induction coils are positioned outside the water cooled segments and spaced apart by a constant interval from each other to allow an RF current to only flow therethrough.

The existing techniques related to the CCIM in which the water cooled segments are positioned inside the induction coils and spaced apart by an interval from each other are disclosed in German Patent No. 518,499, and U.S. Pat. Nos. 3,223,519, 3,461,215, 4,058,668, 6,144,690 and 6,613,291.

However, the existing CCIMs are disadvantageous in that the water cooled segments positioned inside the induction coils consume a lot of electrical energy.

Also, in the case of the existing CCIMs, the induction coils are mostly installed horizontally and designed to mainly focus on the melting of molten materials, but they do not include a function to facilitate discharge of the molten materials.

The existing CCIMs employ a principle that a sliding door is installed at a molten material discharge hole and when the sliding door is opened, heat of the molten material is transferred and after an elapse of a predetermined time, the molten material is discharged to a lower side. However, the CCIMs employing the above principle have a problem in that since the temperature of the molten material is lowered while the molten material is discharged, ceramics or metals having a high melting point may be partially solidified and thus flowability is reduced to not smoothly discharge the molten material.

Another method to discharge a molten material is that a sealed Inconel tube on which an induction coil is wound is used as a discharge tube, and the molten material is discharged by heating the Inconel tube. However, this method has a limitation in discharging metals (e.g., a group of noble metals, etc.) having a higher melting point than the Inconel tube.

DISCLOSURE OF THE INVENTION

Technical Problem

The present invention has been devised to solve the above-mentioned problem, and has an object has to provide a cold crucible induction melter integrating an induction coil and a melting furnace, wherein the induction coil itself simultaneously serves as a water cooled segment to directly transmit an induced current to a molten material in the cold crucible induction melter (CCIM), thereby greatly improving energy efficiency and simultaneously and simplifying the structure of the CCIM.

The present invention has another object to provide a cold crucible induction melter that enables a smooth discharge of a molten material even when the molten material is a ceramic or a metal material with a high melting point.

Technical Solution

Embodiments of the present invention provide a cold crucible induction melter integrating an induction coil and a melting furnace heats and melts waste using an induced current which is generated in the water cooled segment by a high frequency current applied to the induction coil, the cold crucible induction melter characterized in that the water cooled segment and the induction coil are disposed in a vertical direction so that the induced current that is generated by the induction coil is directly transmitted to the molten material of the waste.

The water cooled segment may include a set of a plurality of vertical type water cooled segments formed therein with a U-shaped cooling passage and the vertical type water cooled segments may be configured such that a cooling medium is distributed in the unit of several groups and circulated.

A water cooled bottom plate may be disposed under the induction coil, eccentrically disposed toward a point in a discharge direction of the molten material and downwardly sloped so as to collect the molten material in a direction of a segment type molten material discharge part, and the induction coil may have a sloped shape to correspond to the discharge direction of the molten material.

The induction coil may have a heat-resistant ceramic coating layer formed on an inner surface thereof contacting the molten material.

The induction coil may have a structure in which a plurality of induction coil strands are stacked in a vertical direction and a ceramic material may be inserted between the plurality of induction coil strands.

A segment type molten material discharge part may be disposed under the water cooled bottom plate such that the molten material collected by the water cooled bottom plate is discharged, an upper surface of the segment type molten material discharge part may be comprised of a downwardly sloped surface directed toward a molten material discharge hole formed at a center thereof, and an induction coil may be provided around the molten material discharge hole water cooled segment formed extending downwardly from the molten material discharge hole, through which the molten material passes.

Advantageous Effects

According to the cold crucible induction melter (CCIM) integrating an induction coil and a melting furnace of the present invention, the CCIM of the present invention excludes the structure that a water cooled segment is installed at an inner region of an induction coil in an existing cold crucible induction melter (CCIM) and allows the induction coil itself to simultaneously serve as a water cooled segment, and thus electrical energy which has been mostly consumed by the water cooled segment installed inside the existing induction coil may be directly transmitted to the molten material in the CCIM, thereby considerably improving energy efficiency and simplifying the structure of the CCIM to facilitate disassembly and assembly of the apparatus for maintenance and repair.

Also, according to the present invention, the induction coil is disposed in a sloped structure toward a discharge direction of the molten material and simultaneously the induction coil is provided detachably and attachably around the molten material discharge hole to enhance generation efficiency of an induced current in the discharged molten material, thereby capable of smoothly discharging molten materials such as ceramic materials or metal materials having a high melting point.

BRIEF DESCRIPTION OF THE DRAWINGS

FIG. 1 is an overall schematic view of a cold crucible induction melter integrating an induction coil and a melting furnace according to the present invention;

FIGS. 2(*a*) and 2(*b*) are, respectively, an appearance view and a partial cutaway perspective view of a vertical type water cooled segment in a cold crucible induction melter integrating an induction coil and a melting furnace according to the present invention;

Figure 3:
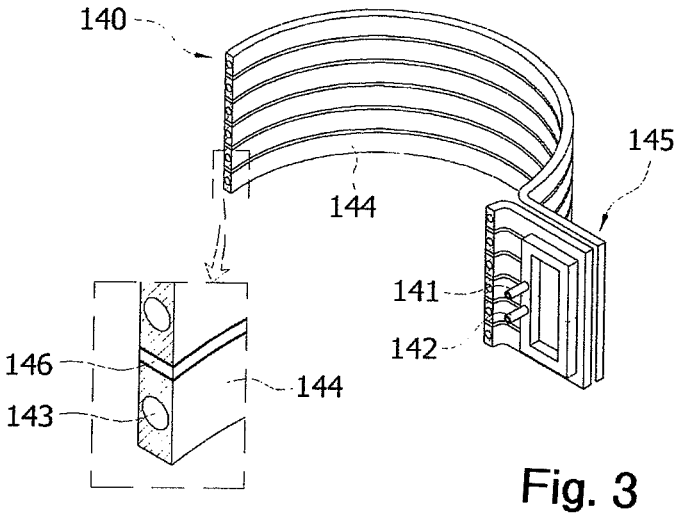
FIG. 3 is a partial cutaway perspective view of a sloped horizontal inductor in a cold crucible induction melter integrating an induction coil and a melting furnace according to the present invention.

| * Description of Symbols* | |
|---|---|
| 100: Cold crucible induction melter | 110: Upper chamber |
| 101: Waste inlet | 102: Waste outlet |
| 105: Connecting part | 120: Cooling water inlet/outlet distributing pipe |
| 121: Cooling water inlet distributing pipe | 122: Cooling water outlet distributing pipe |
| 130: Vertical type water cooled segment | 131: Cooling water inlet |
| 132: Cooling water outlet | 133: U-shaped cooling passage |
| 140: Sloped horizontal inductor | 141: Cooling water inlet |
| 142: Cooling water outlet | 143: Cooling water flow pipe |
| 144: Inner surface of induction coil | 145: High frequency power supply unit connecting part |
| 146: Ceramic insertion member | 150: Sloped water cooled bottom plate |
| 151: Cooling water inlet | 152: Cooling water outlet |
| 153: Cooling flow plate | 160: Segment type molten material discharge part |
| 161: Cooling water inlet | 162: Cooling water outlet |
| 163: Sloped surface | 164: Molten material discharge hole |
| 165: Molten material discharge hole water cooled segment | 170: Induction coil |

MODE FOR CARRYING OUT THE INVENTION

Hereinafter, configuration and operation of a cold crucible induction melter according to a preferred embodiment of the present invention will be described in detail with reference to the accompanying drawings.

FIG. 1 is an overall schematic view of a cold crucible induction melter integrating an induction coil and a melting furnace according to the present invention.

The cold crucible induction melter 100 integrating an induction coil and a melting furnace according to the present invention includes an upper chamber 110 provided with a waste inlet 101 in which a melting target material, such as radioactive waste, general industrial waste, ceramic materials, metal materials, or the like is put, and an off-gas outlet 102 through which an off-gas generated during melting is discharged, and a lower chamber disposed under the upper chamber 110, and connected to the upper chamber 110 by a joint 105 disposed therebetween, in which the put waste is received, molten and discharged. The lower chamber includes a structure in which a vertical type water cooled segment 130, a sloped horizontal inductor 140, and a sloped water cooled bottom plate 150 are sequentially coupled from an upper side to a lower side, and a segment type molten material discharge part 160 through which the molten material is discharged is connected to a lower side of the sloped water cooled bottom plate 150.

A cooling water inlet/outlet distributing pipe 120 comprised of a cooling water inlet distributing pipe 121 and a cooling water outlet distributing pipe 122 is installed around the vertical type water cooled segment 130, a high frequency power supply unit connecting part 145 is connected to one side of the sloped horizontal inductor 140, and an induction coil 170 is installed around the segment type molten material discharge part 160.

FIG. 2(*a*) is an appearance perspective view and FIG. 2(*b*) a partial cutaway perspective view of a vertical type water cooled segment in a cold crucible induction melter integrating an induction coil and a melting furnace according to the present invention.

The vertical type water cooled segment 130 includes a set of unit sections having a U-shaped cooling passage 133 through which a cooling medium such as cooling water flows, the unit sections connected along a circumferential direction, as illustrated in FIGS. 2(*a*) and 2(*b*).

A cooling water inlet 131 and a cooling water outlet 132 connected to the U-shaped cooling passage 133 are formed at an upper outer side of the vertical type water cooled segment 130. The cooling water inlet 131 and the cooling water outlet 132 are connected to the cooling water inlet distributing pipe 121 and the cooling water outlet distributing pipe 122 illustrated in FIG. 1, respectively.

The cooling water inlet/outlet distributing pipe 120 is configured to connect the vertical type water cooled segments 130 to each other in the unit of several groups such that the cooling medium is supplied or withdrawn. Thus, by configuring the vertical type water cooled segments 130 such that the cooling medium is distributed in the unit of several groups each having the vertical type water cooled segments 130, uniform cooling between the vertical type water cooled segments 130 may be obtained to thus enhance cooling efficiency.

An upper surface of each of the vertical type water cooled segments 130 is a plane surface so as to closely contact a lower surface of the joint 105 along a circumference of the joint 105, and a lower surface of each of the vertical type water cooled segments 130 is a sloped surface so as to closely contact a sloped upper surface of the sloped horizontal inductor 140 coupled to the lower surface of the vertical type water cooled segments 130.

The vertical type water cooled segments 130 transmit an induced current induced by an RF current of the sloped horizontal inductor 140 to a molten material received therein to heat the molten material.

FIG. 3 is a partial cutaway perspective view of a sloped horizontal inductor in a cold crucible induction melter integrating an induction coil and a melting furnace according to the present invention.

The sloped horizontal inductor 140 illustrated in FIG. 3 is positioned under the vertical type water cooled segment 130 in an integral type, and has a structure in which an inner surface contacts the molten material.

That is, unlike the existing structure that the water cooled segment is positioned inside the induction coil and a molten material contacts an inner surface of the water cooled segment, since the present invention has the structure that a molten material directly contacts the inner surface of the sloped horizontal inductor 140, it is technically characterized in that the sloped horizontal inductor 140 itself has an integral structure to directly heat the molten material and simultaneously server as the water cooled segment.

Also, the sloped horizontal inductor 140 is characterized in that it constitutes a lower portion of the lower chamber and is sloped so as to correspond to a direction where the molten material is discharged sloped downwardly, thereby allowing an induced current to be more effectively transmitted to the discharged molten material.

The sloped horizontal inductor 140 has a structure that a plurality of tube type induction coil strands are stacked sloped in a vertical direction so as to flexibly respond to a thermal deformation such as expansion of a material due to heat of an inside of the melting furnace and to facilitate the manufacturing thereof.

The inner surface 144 of the sloped horizontal inductor 140 contacting the molten material is first coated with a metal alloy layer and then secondly coated thereon with a ceramic coating layer such as alumina (Al2O3) so that the inner surface 144 may be protected from corrosion or a physical damage due to contact with the molten material.

Also, a ceramic insertion member 146 is interposed between the tube type induction coil strands to minimize thermal deformation of the tube type induction coil strands.

A high frequency power supply unit connecting part 145 connected to a high frequency generator (HFG) that is a power supply unit is electrically connected to the sloped horizontal inductor 140 at one side of the sloped horizontal inductor 140, and a cooling water inlet 141 and a cooling water outlet 142 connected to the cooling water flow passage 143 formed at an inside of each of the tube type induction coil strands are formed in the high frequency power supply unit connecting part 145.

Figure 4A:
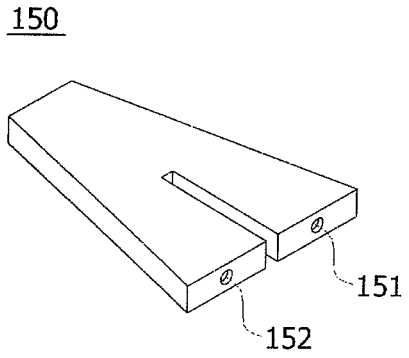
FIGS. 4(*a*) and 4(*b*) are, respectively, an appearance view and a partial cutaway perspective view of a sloped water cooled bottom plate in a cold crucible induction melter integrating an induction coil and a melting furnace according to the present invention.
Figure 4B:
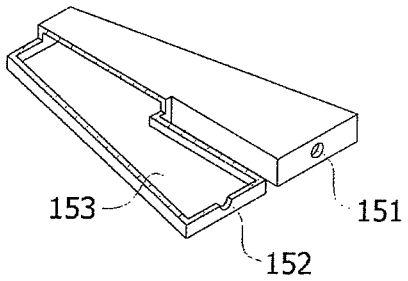

FIG. 4(*a*) is an appearance perspective view and FIG. 4(*b*) a partial cutaway perspective view of a sloped water cooled bottom plate in a cold crucible induction melter integrating an induction coil and a melting furnace according to the present invention.

The sloped water cooled bottom plate 150 positioned under the sloped horizontal inductor 140 is comprised of a set of unit sections each having a circular arc shape and coupled to each other as illustrated in FIGS. 4(*a*) and 4(*b*), is eccentrically disposed toward a direction sloped downwardly of the sloped horizontal inductor 140 so as to smoothly discharge the molten material, and is connected to the segment type molten material discharge part 160 disposed thereunder as illustrated in FIG. 1.

A cooling water inlet 151 and a cooling water outlet 152 are provided in an outer surface of the sloped water cooled bottom plate 150 and are connected to a U-shaped cooling flow plate 153 formed at an inside of the sloped water cooled bottom plate 150.

Thus, the sloped water cooled bottom plate 150 is comprised of a set of unit sections, and the cooling flow plate 153 is provided to an inside of the unit section of the sloped water cooled bottom plate 150 such that the cooling medium is circulated, thereby effectively preventing the sloped water cooled bottom plate 150 from being overheated due to heat of the molten material.

Figure 5:
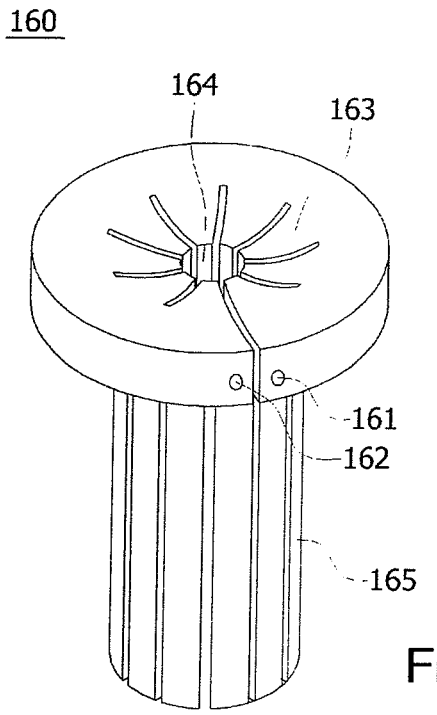
FIG. 5 is a perspective view of a segment type molten material discharge part in a cold crucible induction melter integrating an induction coil and a melting furnace.
Figure 6:
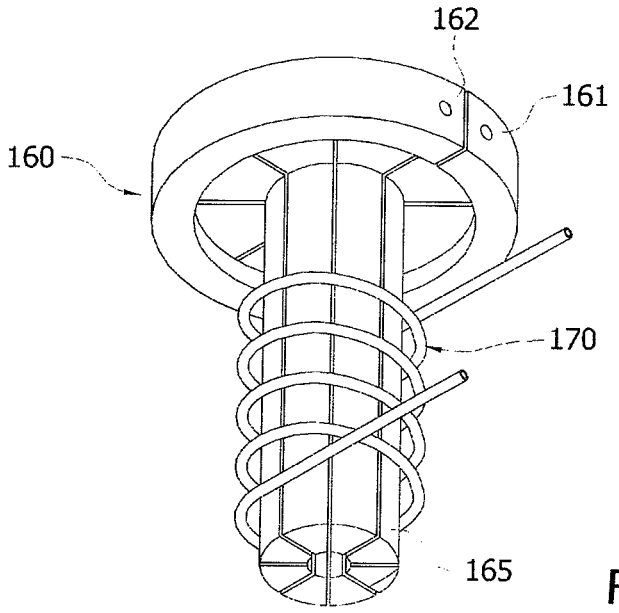
FIG. 6 is a perspective view of the segment type molten material discharge part illustrated in FIG. 5 and provided around a molten material discharge hole water cooled segment with an induction coil.

FIG. 5 is a perspective view of a segment type molten material discharge part in a cold crucible induction melter integrating an induction coil and a melting furnace, and FIG. 6 is a perspective view of the segment type molten material discharge part illustrated in FIG. 5 and provided around a molten material discharge hole water cooled segment with an induction coil.

As illustrated in FIG. 5, the molten material discharge part 160 positioned under the sloped water cooled bottom plate 150 has an upper surface which is comprised of a downwardly sloped surface 163 directed toward a molten material discharge hole 164 formed at a center thereof, and a cooling water inlet 161 and a cooling water outlet 162 formed at a side of the molten material discharge part 160 to supply or withdraw a cooling medium so as to prevent overheating.

As illustrated in FIG. 6, an induction coil 170 is provided around the molten material discharge hole water cooled segment 165 formed extending downwardly from the molten material discharge hole 164, through which the molten material passes.

Thus, by installing the induction coil 170 around the molten material discharge hole water cooled segment 165 and supplying a high frequency electrical energy to the induction coil 170, it becomes possible to direct melt ceramic materials such as glass, and metal materials having a high melting point while such materials are discharged, thereby preventing the molten material from being solidified and thus making it possible to smoothly discharge the molten material.

What is claimed is:

1. A cold crucible induction furnace comprising:

an upper chamber having, at an upper portion, an inlet port for introducing material to be melted in the furnace and having a central axis that is generally vertical;

a lower chamber, attached to and below the upper chamber, wherein the lower chamber comprises a plurality of generally vertical segments that are circumferentially joined to each other, each of the generally vertical segments is water cooled and includes a generally U-shaped internal flow path for the flow of cooling water the lower chamber includes an inductor positioned vertically below and coupled to the plurality of generally vertical water-cooled segments, the inductor includes a plurality of tubular induction coil strands stacked in a vertical direction, the inductor has a heat-resistant ceramic coating layer on an inner surface of the inductor that is directly contacted by the material, when the material is melted, the inductor is sloped relative to a plane that is transverse to the central axis of the upper chamber, and the inductor, when supplied with high frequency power, induces an electrical current in the material, heating and melting the material;

a water cooled sloped bottom plate attached to the lower chamber, below the lower chamber, that is sloped relative to the plane that is transverse to the central axis of the upper chamber, and that includes an outlet hole in fluid communication with the lower chamber for discharge of the molten material, when melted, from the lower chamber, wherein the outlet hole is located at a lowermost portion of the bottom plate, and is eccentrically located with respect to the central axis of the upper chamber; and a molten material discharge part attached to the bottom plate and having a central hole providing a flow path for molten material out of the lower chamber of the induction furnace through the outlet hole in the water cooled sloped bottom plate.

2. The cold crucible induction furnace of claim 1, wherein the inductor includes a ceramic material between the tubular induction coil strands.

3. The cold crucible induction furnace of claim 1, wherein the water cooled sloped bottom plate includes a plurality of water cooled units circumferentially joined to each other, and each of the water cooled units includes a generally U-shaped internal flow path for the flow of cooling water.

4. The cold crucible induction furnace of claim 1, further comprising an auxiliary induction coil located around the molten material discharge part, wherein an upper surface of the molten material discharge part comprises a downwardly sloped surface directed toward the outlet hole in the water cooled sloped bottom plate, the sloped surface has a discharge hole located at a center of the downwardly sloped surface, and the molten material discharge part includes a water inlet and a water outlet for water cooling the molten material discharge part.

5. A cold crucible induction furnace comprising:

an upper chamber having, at an upper portion, an inlet port for introducing material to be melted in the furnace and having a central axis that is generally vertical;

a lower chamber, attached to and below the upper chamber, wherein the lower chamber includes a plurality of generally vertical water-cooled segments that are circumferentially joined to each other and each of the generally vertical water-cooled lower chamber segments includes a generally U-shaped internal flow path for the flow of cooling water, and an inductor positioned vertically below and coupled to the plurality of generally vertical water-cooled segments, wherein the inductor includes a plurality of tubular induction coil strands stacked in a vertical direction and surrounding the lower chamber, and a heat-resistant ceramic coating layer on an inner surface of the inductor directly contacting the material in the lower chamber, when the material is melted; and a water-cooled sloped bottom plate coupled to and located below the inductor, covering the lower chamber from below, wherein the water-cooled sloped bottom plate is sloped relative to a plane that is transverse to the central axis of the upper chamber, the water-cooled sloped bottom plate includes an outlet hole wherein the outlet hole is in fluid communication with the lower chamber for discharge of the molten material, when melted, from the lower chamber, is located at a lowermost portion of the water-cooled sloped bottom, and is eccentrically located with respect to the central axis of the upper chamber, the water-cooled sloped bottom plate includes a plurality of water cooled units joined to each other, and each of the water-cooled units includes a generally U-shaped internal flow path for the flow of cooling water.

6. The cold crucible induction furnace of claim 5, wherein the inductor is sloped relative to the plane that is transverse to the central axis of the upper chamber, and the inductor, when supplied with high frequency power, induces an electrical current in the material, heating and melting the material.

7. The cold crucible induction furnace of claim 6, wherein the inductor has a slope and the water-cooled sloped bottom plate has a slope and the slope of the inductor corresponds to the slope of the water-cooled sloped bottom plate for smoothly discharging the molten material from the lower chamber at the lowermost portion of the water-cooled sloped bottom plate.

8. The cold crucible induction furnace of claim 5 further comprising a molten material discharge part attached to the water-cooled sloped bottom plate and having a central hole communicating with the outlet hole of the water-cooled sloped bottom plate and providing a flow path for molten material out of the lower chamber of the induction furnace through the outlet hole in the water cooled sloped bottom plate.

9. The cold crucible induction furnace of claim 8, further comprising an auxiliary induction coil located around the molten material discharge part, wherein an upper surface of the molten material discharge part comprises a downwardly sloped surface directed toward the outlet hole in the water cooled sloped bottom plate, the downwardly sloped surface of the upper surface of the molten material discharge part has a discharge hole located at a center of the downwardly sloped surface, and the molten material discharge part includes a water inlet and a water outlet for water cooling the molten material discharge part.

10. The cold crucible induction furnace of claim 5, wherein the inductor includes a ceramic material between the tubular induction coil strands.

* * * * *